United States Patent [19]

Andersen et al.

[11] 4,342,256

[45] Aug. 3, 1982

[54] CONTROL DEVICE FOR A HYDRAULIC MOTOR

[75] Inventors: Hans S. Andersen, Augustenborg; Helge K. Christensen; Preben Christiansen, both of Nordborg, all of Denmark

[73] Assignee: Danfoss, A/S, Nordborg, Denmark

[21] Appl. No.: 41,392

[22] Filed: May 22, 1979

Related U.S. Application Data

[63] Continuation of Ser. No. 833,877, Sep. 16, 1977, abandoned.

[30] Foreign Application Priority Data

Sep. 21, 1976 [DE] Fed. Rep. of Germany ..... 2642337

[51] Int. Cl.[3] ..... F15B 13/042

[52] U.S. Cl. ..... 91/420; 91/435; 91/447; 137/596.2

[58] Field of Search ..... 91/420, 447, 435; 137/596, 596.2; 60/460

[56] References Cited

U.S. PATENT DOCUMENTS

| | | | |
|---|---|---|---|
| 2,477,669 | 8/1949 | Stephens | 91/436 X |
| 3,272,085 | 9/1966 | Hajma | 91/420 |
| 3,633,461 | 1/1972 | Komatsu-shi et al. | 91/436 |
| 3,693,506 | 9/1972 | McMillen et al. | 91/433 X |
| 3,792,715 | 2/1974 | Parrett et al. | 137/596.2 X |
| 3,915,067 | 10/1975 | Glore | 91/420 |
| 4,078,475 | 3/1978 | Fillion | 91/420 |

*Primary Examiner*—Irwin C. Cohen
*Attorney, Agent, or Firm*—Wayne B. Easton

[57] ABSTRACT

The invention relates to a hydraulic motor assembly which includes a hydraulic servomotor operable in either direction with a control valve. When the motor is operated in a selected direction, as distinguished from the return direction, it is desired that external forces acting on linkage connected to the piston of the hydraulic motor do not alter the speed of the piston. The control valve has two operating positions and two sets of supply and return passages which facilitate operation of the servomotor in either direction. A brake valve between one of the servomotor ports and the control valve has a scanning port which scans or senses the downstream pressure of either of the control valve supply passages, depending on the control position of the control valve. When the servomotor is operated in the selected direction and an external force as referred to above is encountered, the brake valve operates in response to an increased pressure in the return line and a decreased pressure in the supply line, sensed through the scanning port thereof, to throttle the flow of return fluid in the return line to thereby dampen the tendency of the servomotor to accelerate responsive to the externally applied force. In addition to this function the brake valve is also arranged to allow the return line to be pressurized with supply fluid to effect movement of the servomotor in the return direction.

3 Claims, 2 Drawing Figures

CONTROL DEVICE FOR A HYDRAULIC MOTOR

Figure 1:
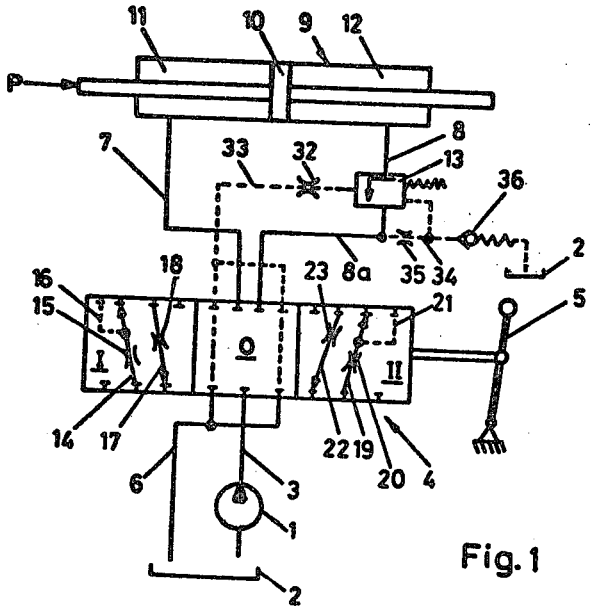

This is a continuation application of application Ser. No. 833,877 filed Sept. 16, 1977 now abandoned.

The invention relates to a control device for a hydraulic motor, comprising a four-way valve to set the direction of motion of the motor, a braking valve which is disposed in the return line between the motor and the four-way valve and is biased in the closing direction by a spring and in the opening direction by the motor supply pressure effective in a first pressure chamber, and means for using the return line upon reversal of direction.

Such a braking valve has the purpose of avoiding unintentional adjustment of the motor caused by an exterior load. In the neutral position of the four-way valve, the braking valve is closed so that every return flow and thus an adjustment of the motor under the influence of an exterior load is avoided. When the motor is to be moved and it is therefore fed with a supply pressure, the latter forces the braking valve into the open position against the force of the spring. When the motor is influenced in the desired direction of motion by the exterior load, the supply pressure drops; it could even become zero or negative when the load adjusts the motor more rapidly than the pump replenishes the pressure fluid. When the supply pressure becomes smaller, the spring presses the braking valve into an intermediate throttling position. However, there are in this case considerable time delays. The braking valve is bridged by a check valve which opens when the return line has to serve as a supply line upon reversal of direction. This check valve has to be designed to be so large that the entire supplied pressure fluid can flow through without considerable throttling losses.

The invention is based on the problem of providing a control device of the aforementioned kind in which the braking valve responds more quickly and accurately.

This problem is solved according to the invention in that the four-way valve has, in the supply direction as well as in the return direction, a throttle for setting the motor speed, and that the braking valve is additionally biased in the closing direction by the pressure in the return throttle effective in a second pressure chamber.

By arranging a return flow throttle in the four-way valve, a pressure is produced which additionally acts on the braking valve in the closing direction. When, as a result of an external load, the motor tends to assume a higher speed, the pressure upstream of the return throttle rises immediately, with the result that the braking valve is also returned immediately from the fully open to a throttling position. This occurs before the supply pressure has dropped markedly. There is thus rapid and accurate control of the braking valve.

In a further development of the invention, it is ensured that, on the side of the supply throttles facing the motor, the four-way valve comprises branching-off sensing passages of which the one that has the supply pressure is connected to the first pressure chamber of the braking valve, and that the second chamber of the braking valve is connected to the tank by way of an auxiliary valve which opens when a predetermined pressure is exceeded.

In this way, a special check valve is dispensed with. Its function is instead performed by the braking valve. If the braking valve is disposed in the supply line, both pressure chambers are under the supply pressure. However, since this pressure is reduced in the second pressure chamber by way of the auxiliary valve, the pressure in the first pressure chamber predominates, with the result that the braking valve is fully open. Desirably, a fixed throttle is disposed in the supply line to the second pressure chamber; a pressure drop occurs at the throttle when the auxiliary valve is open.

Figure 2:
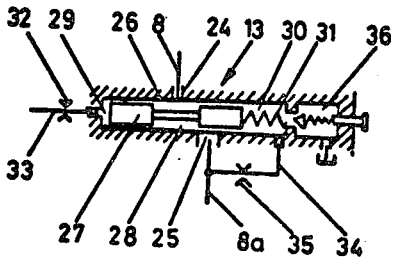

The invention will now be described with reference to an example illustrated in the drawing, wherein:

FIG. 1 is a diagrammatic representation of a control device according to the invention, and FIG. 2 is a diagrammatic represenation of the braking valve that is used.

According to FIG. 1, a pump 1 feeds pressure fluid from a tank 2 through a pump conduit 3 to a four-way valve 4 which is adjustable by means of an actuating element 5. This valve 4 is connected to the tank by way of a tank conduit 6. Two operating lines 7 and 8 extend from the four-way valve 4 to the motor 9 of which the piston 10 is displaced in response to the pressure supplied to its pressure chambers 11 and 12. A braking valve 13 is provided in the operating line 8.

Apart from the neutral position 0, the four-way valve 4 can assume an operative position I, in which the piston 10 moves to the right, and an operative position II, in which the piston moves to the left. In the position I there are a supply passage 14 with a supply throttle 15, beyond which a sensing passage 16 branches off, and a return passage 17 with a return throttle 18. In the position II there are a supply passage 19 with a supply throttle 20, beyond which a sensing passage 21 branches off, and a return passage 22 with a return throttle 23.

The braking valve 13 has a connecting nipple 24 on the motor side and a nipple 25 directed away from the motor. A slide 27 with an annular groove 28 is mounted in a bore 26 and permits the two nipples to be connected. To both ends of the slide there are a first pressure chamber 29 and a second pressure chamber 30 in which there is also provided a spring 31. The first pressure chamber 29 is connected by way of a fixed throttle 32 to a control line 33 which, in the positions I and II of the four-way valve 4, is connected to the sensing line 16 or 21 and therefore always scans the supply pressure downstream of the supply throttle 15 or 20. The second pressure chamber 30 is connected, by way of a control line 34 having a fixed throttle 35, to a section **8*a* of the operating line between the four-way valve 4 and the braking valve 13. This pressure chamber therefore scans the return pressure upstream of the return throttle 18 in the position I of the four-way valve 4, and the supply pressure downstream of the supply throttle 20 in the position II. The second pressure chamber 30 is connected to the tank 2 by way of an auxiliary valve 36** which opens when a predetermined pressure is exceeded.

This results in the following manner of operation:

When the four-way valve 4 is displaced to the right into position I, the motor 9 receives pressure fluid in the pressure chamber 11. The piston 10 therefore moves to the right. The speed depends on the set throttle resistance of the supply throttle 15 and the return throttle 18. The force exerted on the end of the slide 27 by the supply pressure in the pressure chamber 29 predominates over the force of the spring 31 and the force exerted on the end of the slide 27 by the pressure in the pressure chamber 30. The braking valve is therefore fully open. When an external load P acts on the piston 10, there is a rise in the pressure upstream of the return throttle 18 and thus in the pressure chamber 30. The braking valve therefore moves to a throttling position. This adjustment is supported by the fact that the pressure also drops in the operating line 7 serving as a supply. The operating speed of the motor 9 is therefore kept substantially constant irrespective of the external load.

If the four-way valve 4 is displaced to the left into the position II, the supply pressure downstream of the supply throttle 20 exists in the first pressure chamber 29. The supply pressure also tends to build up in the second pressure chamber 30 but this does not actually occur because, on exceeding the set limiting pressure, the auxiliary valve 36 opens and there now occurs at the fixed throttle 35 a pressure drop that reduces the pressure in the second pressure chamber 30. The force exerted by the pressure in the first pressure chamber 29 thus predominates and the braking valve 13 moves to the fully open position. Pressure fluid then flows into the pressure chamber 12 of the motor 9 depending on the throttling position of the supply throttle 20 and the return throttle 23. The piston 10 of the motor moves to the left.

We claim:

1. A hydraulic motor assembly, comprising a motor having a piston forming first and second expansible chambers on opposite sides thereof, first and second ports respectively for said chambers, supply and return lines, a control valve between said lines and said motor, said control valve having first position supply and exhaust passages for respective fluid communication with said first and second motor ports and second position supply and exhaust passages for respective fluid communication with said second and first motor ports, said control valve first position exhaust passage being a throttle passage with a set throttle resistance for restricting the flow of fluid therethrough, a brake valve between said second motor port and said control valve, said brake valve having first and second through-flow ports respectively on the control valve and motor sides of said brake valve, said brake valve having first and second pressure chambers, piston means having first and second connected heads respectively in said pressure chambers and being separated by connection means to provide fluid flow passage means between said through-flow ports and between said heads, said piston means being bistable in valve opening and closing directions relative to said through-flow ports in respective response to oppositely acting pressures in said first and second pressure chambers, said second head being in valve throttling relation to said first through-flow port, means biasing said brake valve toward a position of said second head blocking said first through-flow port, scanning contrl port means for said brake valve having fluid communication with said first pressure chamber thereof for sensing supply pressure downstream of said supply passage of said control valve for said first position of said control valve, fluid connecting means between said first brake valve through port and said second brake valve pressure chamber, the pressure at said first brake valve through-port and in said second brake valve chamber thereby being directly responsive to the rate of fluid flow through said brake valve due to the fluid flow restrictive action of said first position exhaust throttle passage when said control valve is in its first position, said fluid flow restrictive action being sufficient to significantly affect the pressure in said second brake valve chamber to increase the valve closing force thereof upon in increase in the rate of fluid flowing through said brake valve.

2. A hydraulic motor assembly according to claim 1 wherein all of said control valve first and second position supply and exhaust passages are throttle passages with set throttle resistance.

3. A hydraulic motor assembly according to claim 2 wherein said scanning control port means senses supply pressure downstream of said supply throttling passage of said control valve for said second position of said control valve, throttle means in said fluid connecting means, check valve means connected between said throttle means and said second brake valve pressure chamber and exhausting in parallel with said return line, said check valve means limiting the pressure in said second pressure chamber below the supply pressure in said first pressure chamber to facilitate opening of said brake valve when said control valve is in its second position.

* * * * *